United States Patent [19]

Graillat

[11] Patent Number: 4,789,177

[45] Date of Patent: Dec. 6, 1988

[54] THREE POINT SUPPORT

[75] Inventor: Gerard Graillat, Annecy, France

[73] Assignee: Salomon S.A., Annecy Cedex, France

[21] Appl. No.: 925,899

[22] Filed: Nov. 3, 1986

[30] Foreign Application Priority Data

Nov. 15, 1985 [FR] France ..... 85 16947

[51] Int. Cl.[4] ..... A63C 9/20

[52] U.S. Cl. ..... 280/607; 280/615; 280/636

[58] Field of Search ..... 280/614, 615, 607, 636

[56] References Cited

U.S. PATENT DOCUMENTS

| | | | |
|---|---|---|---|
| 3,438,828 | 4/1969 | Bjornestad | 156/171 |
| 4,316,618 | 2/1982 | Sampson | 280/613 |
| 4,353,576 | 10/1982 | Salomon | 280/615 |

FOREIGN PATENT DOCUMENTS

| | | | |
|---|---|---|---|
| 0368368 | 10/1982 | Austria . | |
| 1140959 | 2/1983 | Canada | 280/636 |
| 0416372 | 8/1925 | Fed. Rep. of Germany . | |
| 3310739 | 10/1983 | Fed. Rep. of Germany . | |
| 3518400 | 12/1985 | Fed. Rep. of Germany | 280/615 |
| 3538427 | 5/1986 | Fed. Rep. of Germany | 280/615 |
| 1435195 | 3/1966 | France . | |
| 2443853 | 7/1980 | France . | |
| 2450618 | 10/1980 | France . | |
| 2483240 | 12/1981 | France | 280/615 |
| 2553669 | 4/1985 | France . | |
| 8516153 | 10/1985 | France . | |
| 2565116 | 12/1985 | France . | |
| 2565117 | 12/1985 | France . | |
| 8203559 | 10/1982 | PCT Int'l Appl. . | |
| 0088427 | 2/1937 | Sweden . | |

*Primary Examiner*—Mitchell David M.
*Assistant Examiner*—Brian L. Johnson
*Attorney, Agent, or Firm*—Sandler & Greenblum

[57] ABSTRACT

A lateral guidance and support apparatus for a shoe fixed at its front end on a cross-country ski. The apparatus includes a rib attached to the ski which is adapted to engage a groove in the sole of the shoe having substantially the same cross-sectional configuration and area as the rib. The rib and the groove both include an anterior metatarsus support zone for supporting the metatarses of the foot and a posterior heel support zone for supporting the heel of the foot. The height of the rib and the depth of the groove are chosen such that in the anterior support zone of the metatarses the height of the rib is less than the depth of the groove. As a result, in this zone the sole is supported on the upper surface of the ski in two zones on either lateral side of the rib. In addition, the height of the rib and the depth of the groove are also chosen such that in the posterior heel support zone the height of the rib is greater than the depth of the groove. As a result, the heel of the boot is supported only on a central zone on the upper surface of the rib. Consequently, the boot is supported at three points on the ski, thereby increasing the stability of the skier during skiing and increasing the feeling of attachment to the ski.

19 Claims, 3 Drawing Sheets

THREE POINT SUPPORT

BACKGROUND OF THE INVENTION

1. Field of the Invention

The present invention relates to a lateral guidance and support apparatus for a ski shoe or boot which is attached at its front end to a cross-country ski and whose heel is free to be displaced at least vertically with respect to the ski. In addition, the present invention also relates to a cross-country ski and a boot which assure such lateral guidance.

2. Description of Background Information

Various apparatus are known which laterally guide and retain a cross-country ski shoe or boot with respect to the ski. Some of these apparatus rely on a longitudinally extending guidance rib on the ski which engages a groove of the same configuration provided in the sole of the shoe to laterally guide and retain the shoe on the ski during the lifting and lowering of the shoe on the ski, i.e., when the shoe flattens on the ski. This guidance rib, also called a longitudinal centering rib, can extend the length of the plantar support zone, as is described in French Patent Nos. 2,443,853 2,565,116, and 2,565,117, assigned to the assignee of the present invention.

Although presently known guidance ribs provide some stability for the the skier and provide some sensation of attachment to the ski, neither of these characteristics is present in as large a degree as is desirable in presently known guidance ribs.

Thus, there is a need for a lateral guidance and support rib which increases the stability of the skier and increases the sensation of attachment to the ski as compared to traditional guidance ribs.

SUMMARY OF THE INVENTION

It is an object of the present invention to provide a lateral guidance and support rib which increases the sensation of attachment to the ski and which increases the stability of the skier as compared to presently known lateral guidance and support ribs.

The present invention which achieves these objectives relates to a lateral guidance and support apparatus for a boot or shoe attached to a ski. The apparatus comprises a longitudinally extending guidance element on the upper surface of the ski. The element comprises a front portion and a rear portion. In addition, the apparatus further comprises a sole of the boot or shoe. The sole comprises a groove, and the sole and the groove each comprise a front portion and a rear portion. The groove has substantially the same cross-sectional configuration as the element. The groove comprises means for progressively covering the element in response to flattening of the boot or shoe on the ski. The front portion of the element comprises means for engaging the front portion of the groove when the boot or shoe is flattened on the ski. The rear portion of the element comprises means for engaging the rear portion of the groove when the boot or shoe is flattened on the ski. The height of the front portion of the element is less than the depth of the front portion of the groove. In addition, the height of the rear portion of the element is greater than the depth of the rear portion of the groove.

The element comprises and upper surface and the front portion of the sole is supported on the upper surface of the ski in two zones positioned on either lateral side of the element. The rear portion of the sole is supported only on the upper surface of the element.

The upper surface of the element comprises a central zone, and the upper surface of the ski is positioned on either side of the central zone of the element. The rear portion of the sole is supported only on the central zone.

The element can comprise a rib, and the ski can comprise a cross-country ski. Also, the boot or shoe can be fixed at its front end to the cross-country ski, the boot or shoe is adapted to hold a foot of a skier on the ski, and the boot or shoe is attached to the ski such that the heel of the boot or shoe is adapted to be displaced at least vertically with respect to the ski.

The front portion of the sole comprises the anterior metatarsus support zone for supporting the metatarses of the foot. Also, the rear portion of the sole comprises a posterior heel support zone for supporting the heel of the foot.

In one embodiment the rib has a substantially constant height over substantially the entire length of the rib, and the depth of the groove in the anterior metatarsus support zone is greater than the height of the rib in the anterior metatarsus support zone. Also, the depth of the groove in the posterior heel support zone is less than the height of the rib in the posterior heel support zone.

In another embodiment the groove has a substantially constant depth over substantially the entire length of the groove, and the height of the rib in the anterior metarsus support zone is less than the depth of the groove in the anterior metatarsus support zone. Also, the height of the rib in the posterior heel support zone is greater than the depth of the groove in the posterior heel support zone.

In one embodiment the rib extends above the upper surface of the ski. In two other embodiments the invention relates to the apparatus described above in combination with the entire boot or shoe, or in combination with the ski.

In one embodiment the rib forms one unitary, inseparable body with the ski. In an alternative embodiment the rib comprises an element independent from the ski and means for attaching the rib to the ski.

In still another embodiment the invention relates to a lateral guidance and support apparatus for a boot or shoe attached to a ski. The apparatus comprises a longitudinally extending guidance element on the upper surface of the ski, and a sole of the boot or shoe. The sole comprises a groove which has substantially the same cross-sectional configuration as the element. The groove comprises means for progressively covering the element in response to flattening of the boot or shoe on the ski. The element and the sole together comprise means for positioning the support of the sole of the boot or shoe on the ski at only three spaced apart regions on the ski.

The element can comprise a rib, and the sole and groove can comprise an anterior metatarsus support zone for spporting the metatarses of the foot when the foot is placed in the boot or shoe, and a posterior heel support zone for supporting the heel of the boot or shoe when the boot or shoe is placed in the boot or shoe. In addition, the rib can comprise a front portion for engaging the groove in the anterior metatarsus support zone when the boot or shoe is flattened on the ski, and a rear portion for engaging the groove in the posterior heel support zone when the boot or shoe is flattened on the ski. In addition, in this embodiment the ski comprises a front portion and a rear portion. The front portion of the ski comprises the front portion of the rib, and the upper surface of the ski laterally bordering the front portion of the rib. The rear portion of the ski comprises the rear portion of the rib, and the upper surface of the ski laterally bordering the rear portion of the rib. In this embodiment the three spaced apart regions are positioned on the front and rear portions of the ski.

In one embodiment the ski comprises a cross-country ski, and the boot or shoe is fixed at its front end to the cross-country ski. Also, the boot or shoe is adapted to hold a foot of a skier on the ski, and the boot or shoe is attached to the ski such that the heel of the boot or shoe is adapted to be displaced at least vertically with respect to the ski. The invention can also relate to the apparatus defined above in combination with the entire boot or shoe, or in combination with the ski.

The front portion of the rib is positioned between the two lateral edges of the ski such that the upper surface of the front portion of the ski comprises two lateral surfaces laterally bordering the rib on either lateral side of the rib. Also, the height of the front portion of the rib is less than the depth of the anterior metatarsus support zone of the groove. In addition, the height of the rear portion of the rib is greater than the depth of the posterior heel support zone of the groove, whereby the boot or shoe is supported only at three regions comprising: the upper surface of the rear portion of the rib; and the two lateral upper surfaces of the ski laterally bordring the front portion of the rib.

In one embodiment the rib has a substantially constant height over substantially the entire length of the rib. In this embodiment the depth of the groove in the anterior metatarsus support zone is greater than the height of the front portion of the rib. Also, the depth of the groove in the posterior heel support zone is less than the height of the rear portion of the rib.

In another embodiment the groove has a substantially constant depth over substantially the entire length of the groove. In this embodiment the height of the front portion of the rib is less than the depth of the groove in the anterior metatarsus support zone. Also, the height of the rear portion of the rib is greater than the depth of the groove in the posterior heel support zone.

In still another embodiment the invention relates to a lateral guidance and support apparatus for a boot or shoe fixed at its front end on a cross-country ski. The ski comprises an upper surface, and the boot or shoe is adapted to hold a foot therein. The boot or shoe comprises a sole and a heel, and the heel is adapted to be displaced at least vertically with respect to the ski. The apparatus comprises a longitudinally extending guidance rib attached to an upper portion of the ski, and a sole of the boot. The rib comprises an upper surface comprising a central zone. The rib further comprises an anterior metatarsus support zone, and a posterior heel support zone. The sole of the boot or shoe comprises a longitudinally extending groove therein. The groove has substantially the same cross-sectional configuration and area as the rib. The groove comprises means for progressively covering the rib in response to flattening the boot or shoe on the ski. The groove further comprises an anterior metatarsus support zone, and a posterior heel support zone. The height of the rib in the anterior metatarsus support zone is less than the depth of the groove in the anterior metatarsus support zone. In addition, the upper surfaces of the ski comprises two zones positioned on either side of the rib. The sole is supported on the two zones of the upper surface of the ski. The height of the rib in the posterior heel zone is greater than the depth of the groove in the posterior heel zone. The heel of the boot or shoe is supported only on the central zone of the upper surface of the rib.

In one embodiment the central zone is positioned in the posterior heel support zone of the rib, the two zones of the ski extend laterally from either lateral side of the rib, and the upper portion of the ski comprises the upper surface of the ski.

BRIEF DESCRIPTION OF THE DRAWINGS

The invention will now be described by way of non-limiting example with reference to various embodiments of the invention described in the detailed description which follows and with reference to the attached drawings in which.

DESCRIPTION OF PREFERRED EMBODIMENTS

The present invention relates to a lateral guidance and support apparatus for a shoe or boot which is fixed at its front end on a cross-country ski. The shoe or boot comprises a heel which is free to be displaced at least vertically with respect to the ski. The apparatus comprises a longitudinally extending guidance rib positioned on the upper portion of the ski, and the sole of the shoe, which comprises a longitudinally extending groove of substantially the same cross-sectional shape and area as the guidance rib. The groove progressively caps or covers the rib in the course of the flattening of the shoe on the ski. The height of the guidance rib and the depth of the groove of the sole are chosen such that in the anterior metatarsal support zone of the sole and rib the height of the rib is less than the depth of the groove. As a result, in this anterior metatarsal support zone the sole is supported on the upper surface of the ski in two zones positioned respectively on two sides of the guidance rib. In addition, in the posterior heel support zone of the rib and groove, the height of the rib is greater than the depth of the groove. As a result, the heel of the boot is supported only on a central zone on the upper surface of the guidance rib.

By using the lateral guidance and support apparatus of the present invention, the flattened ski shoe is thus supported on the ski at three points, i.e., at two anterior zones positioned, respectively, on two lateral sides of the guidance rib in the support zone of the metatarses, and at a posterior central zone in the support zone of the heel. This three point support gives the skier an excellent feeling of attachment to the ski and a very high stability at the end of the gait of the foot when the shoe is flattening on the ski.

The longitudinal guidance rib can be attached to the upper surface of the ski or the rib can be formed by means of molding at the same time as the rest of the ski is formed. Alternatively, the rib an be formed on the ski by machining the ski so as to remove material from the upper surface of a ski having an initial thickness equal to the sum of the height of the guidance rib and the thickness of the final ski.

Figure 1:
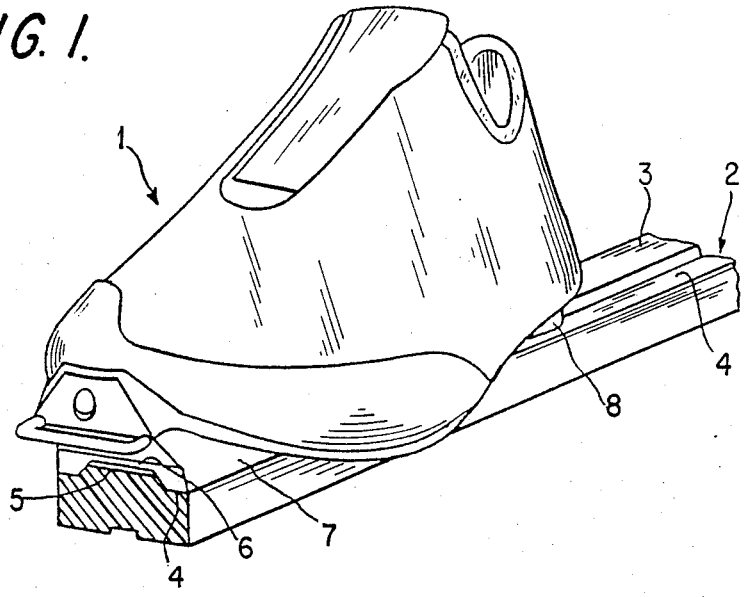
FIG. 1 is a perspective view of a lateral guidance and support apparatus of the present invention of a ski shoe on a cross-country ski, the boot being shown flattened on the ski, at the end of the flattening of the boot on the ski.
Figure 3:
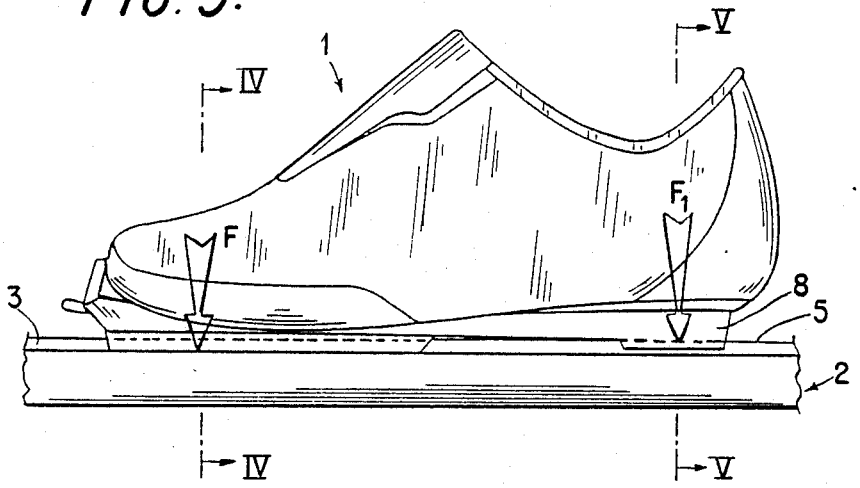
FIG. 3 is an elevational view of the boot flattened on the ski.

In a first embodiment illustrated in FIGS. 1 and 3, the invention relates to a cross-country ski shoe or boot 1 which is attached at its front end to a cross-country ski 2 by means of an appropriate binding (not shown) of any known type. The binding attaching shoe 1 to ski 2 permits the heel of the cross-country ski shoe to be displaced at least vertically with respect to the ski so as to allow for the frontward lifting of the foot. This type of attachment of the shoe to the ski permits a lifting of the heel above the ski, and also permits the heel to descend toward to the ski so that shoe 1 eventually is flattened on ski 2.

Figure 4:
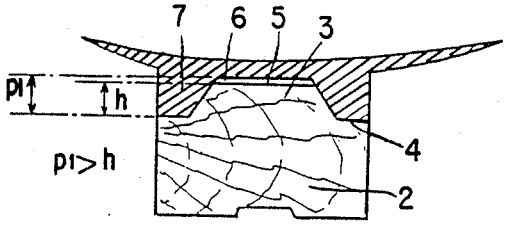
FIG. 4 is a vertical and transverse cross-sectional view taken along line IV—IV of FIG. 3.
Figure 5:
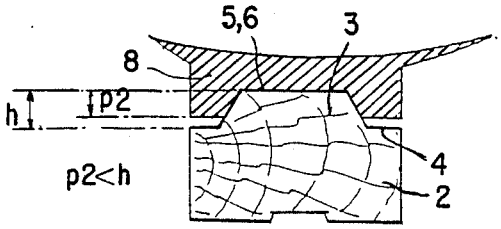
FIG. 5 is a vertical and transverse cross-sectional view taken along line V—V of FIG. 3.

The apparatus of the preset invention laterally guides cross-country ski shoe 1 during its gait, i.e., when shoe 1 is flattened on the ski. The apparatus comprises a longitudinal guidance rib 3 projecting above upper surface 4 of the ski. As a result, upper surface 5 of guidance rib 3 is at a predetermined height h (as seen in FIGS. 4 and 5) above upper surface 4 of the ski. Rib 3 is called a central rib because it is positioned between the two lateral sides of the ski. As a result, upper surface 4 of ski 2 comprises two portions extending laterally from each lateral side of rib 3.

Figure 6:
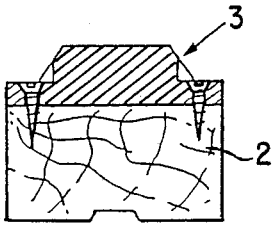
FIG. 6 is a vertical and transverse cross-sectional view showing a guidance rib attached to the ski.

Rib 3 can comprise an element independent from the ski and which is attached to the upper surface of the ski by means such as screws, as is shown in FIG. 6, or rib 3 can be molded with the rest of the ski. Alternatively, rib 3 can be formed by machining the ski to remove material from the upper surface of the ski as is shown particularly in FIGS. 1–5. As a result, either of these last two methods will produce a rib which forms a unitary, inseparable body with ski 2. FIGS. 1–5 show the type of rib 3 which forms one unitary, inseparable body with ski 2, and which can be formed by either of these last two methods.

It is within the scope of the invention for guidance rib 3 to have the cross-sectional shape. For example, rib 3 can have the cross-sectional shape of an isosceles trapezoid as is shown in the FIGS. 1–9. In addition, the cross-sectional area of rib 3 may be constant, or the cross-sectional area of rib 3 can vary in the longitudinal direction along the ski.

In the embodiment illustrated in FIGS. 1–5, guidance rib 3 has a height h whichis constant over its entire length. Rib 3 is adapted to engage a longitudinally extending groove 6 provided in the lower surface of sole 7 of the shoe. In the course of the gait of the foot, i.e., during the flattening of the shoe on the upper surface of the ski, groove 6 progressively caps or covers longitudinally extending central guidance rib 3, so as to permanently assure the correct position of the shoe with respect to the cross-country ski during the entire gait of the foot.

The height h of guidance rib 3 and the depth P of groove 6 of sole 7 of the shoe are chosen such that the height h of guidance rib 3 in the anterior support zone of the metatarsus, indicated by arrow F in FIG. 3, (i.e. that portion of the sole of the boot which supports the metatarses of the foot of the skier when the foot is placed in the boot, and that portion of rib 3 which supports the metatarses of the foot of the skier when the boot is flattened on the ski) is less than depth p1 of groove 6 (as is illustrated in FIG. 4). As a result, sole 7 is supported on upper surface 4 of ski 2 on both lateral sides of rib 3.

Figure 2:
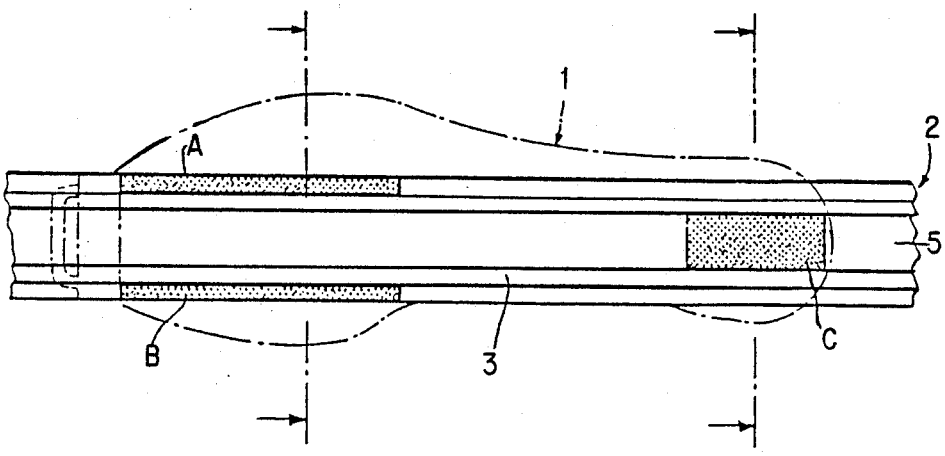
FIG. 2 is a planar view of the cross-country ski alone, with the shoe being removed, this view showing the three support points or regions of the shoe when it is flattened on the ski.

In addition, the height h of rib 3 and the depth p2 of groove 6 of sole 7 are such that the height h of rib 3 in the posterior support zone of the heel of the shoe, indicated by arrow F1 in FIG. 3, (i.e. that portion of the sole of the boot which supports the heel of the foot when the foot is placed in the boot, and that portion of the rib 3 which supports the heel of the boot when the boot is flattened on the ski) is greater than the depth p2 of groove 6 (as illustrated in FIG. 5). As a result, heel 8 of the shoe is supported only on upper surface 5 of guidance rib 3. Thus, as can be seen in FIG. 2, when the shoe is flattened on the cross-country ski the shoe rests on ski 2 at only three points, namely two anterior zones A, B for support of the metatarses, extending longitudinally on the upper surface of the ski on both sides of guidance rib 3, and a third posterior zone C positioned under the heel of the shoe and comprising a portion of upper surface 5 of guidance rib 3.

In the embodiment shown in FIGS. 1–5, guidance rib 3 has a constant height h over its entire length. As a result, the ski shoe must have a longitudinal groove 6 whose depth decreases from the front to the rear of groove 6 so that depth p1 at the front of groove 6, i.e. in the metatarsus support zone, is greater than the height h of the rib 3, while depth p2 of groove 6 at the rear of groove 6, i.e. in the heel support zone, is less than the height of rib 3.

Figure 7:
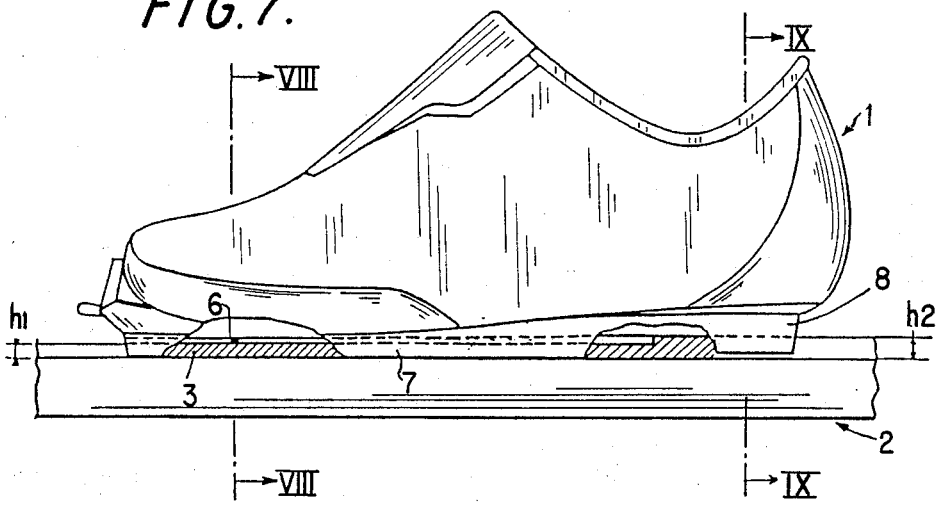
FIG. 7 is an elevational view, partially in vertical and longitudinal cross-section, of an alternative embodiment of the lateral guidance and support apparatus of a ski boot, this boot being shown flat on the cross-country ski.
Figure 8:
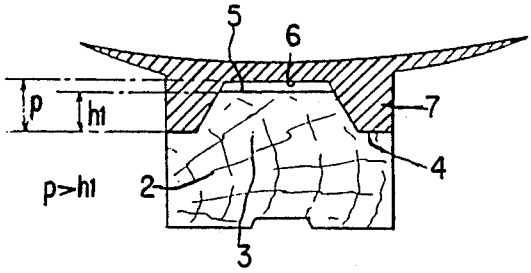
FIG. 8 is a vertical and transverse cross-sectional view taken along line VIII—VIII of FIG. 7.
Figure 9:
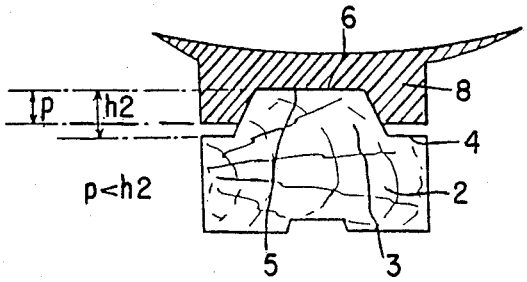
FIG. 9 is a vertical and transverse cross-sectional view taken along line IX—IX of FIG. 7.

In the embodiment illustrated in FIGS. 7, 8 and 9, on the other hand, groove 6 of the sole has a substantially constant depth p over substantially its entire length, while guidance rib 3 has a height which varies in the longitudinal direction of rib 3 and ski 2. (In other respects, however, the embodiment of FIGS. 7–9 is the same as the embodiment of FIGS. 1–6). In this embodiment guidance rib 3 has a height h1 (as illustrated in FIG. 8), in the anterior metatarsus support zone which is less than the depth p of the groove 6. As a result, sole 7 rests on the upper surface 4 of the ski on both sides of guidance rib 3. In addition, the height h2 of rib 3 in the posterior heel support zone, (as illustrated in FIG. 9) is greater than the depth p of the rib. As a result, heel 8 is supported, at the bottom of groove 6 on upper horizontal surface 5 of guidance rib 3.

Although the invention has been described with reference to particular means, materials and embodiments, it is to be understood that the invention is not limited to the particular embodiments disclosed and extends to all equivalents within the scope of the claims.

What is claimed is:

1. A lateral guidance and support apparatus for a boot or shoe attached to a ski, wherein said apparatus comprises:

a longitudinally extending guidance element at the upper surface of said ski, wherein said element comprises a front portion and a rear portion; and a sole of said boot or shoe, wherein said sole comprises a groove, wherein said sole and said groove each comprise a front portion and a rear portion, wherein said groove has substantially the same cross-sectional configuration as said element, wherein said groove comprises means for progressively covering said element in response to flattening of said boot or shoe on said ski, wherein said front portion of said element comprises means for engaging said front portion of said groove when said boot or shoe is flattened on said ski, wherein said rear portion of said element comprises means for engaging said rear portion of said groove when said boot or shoe is flattened on said ski, wherein the height of said front portion of said element is less than the depth of said front portion of said groove, wherein the height of said rear portion of said element is greater than the depth of said rear portion of said groove.

2. The apparatus defined by claim 1 wherein said element comprises an upper surface, wherein said upper surface of said ski comprises two zones positioned on either lateral side of said element, wherein said front portion of said sole supports said two zones on the upper surface of said ski, wherein said rear portion of said sole is supported only on said upper surface of said element.

3. The apparatus defined by claim 2 wherein said upper surface of said element comprises a central zone, wherein said upper surface of said ski is positioned on either side of said central zone of said element, wherein said rear portion of said sole is supported only on said central zone.

4. The apparatus defined by claim 3 wherein said element comprises a rib, wherein said ski comprises a cross-country ski, wherein said boot or shoe is fixed at its front end to said cross-country ski, wherein said boot or shoe is adapted to hold a foot of a skier on said ski, wherein said boot or shoe is attached to said ski such that the heel of said boot or shoe is adapted to be displaced at least vertically with respect to said ski.

5. The apparatus defined by claim 4 wherein said front portion of said sole comprises an anterior metatarsus support zone for supporting the metatarses of said foot.

6. The apparatus defined by claim 5 wherein said rear portion of said sole comprises a posterior heel support zone for supporting the heel of said foot.

7. The apparatus defined by claim 6 wherein said rib has a substantially constant height over substantially the entire length of said rib, wherein the depth of said groove in said anterior metatarsus support zone is greater than the height of said rib in said anterior metatarsus support zone, wherein the depth of said groove in said posterior heel support zone is less than the height of said rib in said posterior heel support zone.

8. The apparatus defined claim 6 wherein said groove has a substantially constant depth over substantially the entire length of said groove, wherein the height of said rib in said anterior metatarsus support zone is less than the depth of said groove in said anterior metatarsus support zone, wherein the height of said rib in said posterior heel support zone is greater than the depth of said groove in said posterior heel support zone.

9. The apparatus defined by claim 6 wherein said rib extends above the upper surface of said ski.

10. The apparatus defined by claim 6 wherein said rib forms one unitary, inseparable body with said ski.

11. The apparatus defined by claim 6 wherein said rib comprises an element independent from said ski and means for attaching said rib to said ski.

12. A lateral guidance and support apparatus for a boot or shoe attached to a cross-country ski, wherein said apparatus comprises:

a longitudinally extending guidance element at the upper surface of said ski, said element comprises a rib, and a sole of said boot or shoe, wherein said sole comprises a groove, said groove having substantially the same cross-sectional configuration as said element, said groove comprising means for progressively covering said element in response to flattening of said boot or shoe on said ski, said element and said sole together comprising means for supporting of said sole of said boot or shoe on said ski at only three spaced apart regions on said ski;

wherein said sole and groove comprise:

an anterior metatarsus support zone for supporting the metatarses of said foot when said foot is placed in said boot or shoe; and a posterior heel support zone for supporting the heel of said foot when said foot is placed in said boot or shoe, wherein said rib comprises:

a front portion for engaging said groove in said anterior metatarsus support zone when said boot or shoe is flattened on said ski;

a rear portion for engaging said groove in said posterior heel support zone when said boot or shoe is flattened on said ski, wherein said ski comprises:

a front portion comprising:

said front portion of said rib; and the upper surface of said ski laterally bordering said front portion of said rib; and a rear portion comprising:

said rear portion of said rib; and the upper surface of said ski comprises at least one zone laterally bordering said rear portion of said rib, wherein said three spaced apart regions are positioned on said front and rear portions of said ski;

wherein said boot or shoe has a front end attached to said cross-country ski, wherein said boot or shoe is adapted to hold a foot of a skier on said ski, wherein said boot or shoe is attached to said ski such that the heel of said boot or shoe is adapted to be displaced at least vertically with respect to said ski; and wherein said front portion of said rib is positioned between the two lateral edges of said ski such that the upper surface of said ski comprises two lateral surfaces laterally bordering said rib on either lateral side of said rib, wherein the height of said front portion of said rib is less than the depth of said anterior metatarsus support zone of said groove, wherein the height of said front portion of said rib is less than the depth of said anterior metatarsus support zone of said groove, wherein the height of said rear portion of said rib is greater than the depth of said posterior heel support zone of said groove, whereby said boot or shoe is supported only at three regions comprising:

the upper surface of said rear portion of said rib; and said two lateral upper surfaces of said ski laterally bordering said front portion of said rib.

13. The apparatus defined by claim 12 wherein said rib has a substantially constant height over substantially the entire length of said rib, wherein the depth of said groove in said anterior metatarsus support zone is greater than the height of said front portion of said rib, wherein the depth of said groove in said posterior heel support zone is less than the height of said rear portion of said rib.

14. The apparatus defined claim 12 wherein said groove has a substantially constant depth over substantially the entire length of said groove, wherein the height of said front portion of said rib is less than the depth of said groove in said anterior metatarsus support zone, wherein the height of said rear portion of said rib is greater than the depth of said groove in said posterior heel support zone.

15. A lateral guidance and support apparatus for a boot or shoe fixed at its front end on a cross-country ski, wherein said ski comprises an upper surface, wherein said boot or shoe is adapted to hold a foot therein, wherein said boot or shoe comprises a sole and a heel, wherein said heel is adapted to be displaced at least vertically with respect to said ski, wherein said apparatus comprises:

a longitudinally extending guidance rib attached to an upper portion of said ski, wherein said rib comprises an upper surface comprising a central zone, wherein said rib further comprises:

an anterior metatarsus support zone; and a posterior heel support zone; and a sole of said boot or shoe comprising a longitudinally extending groove therein, wherein said groove has substantially the same cross-sectional configuration and area as said rib, wherein said groove comprises means for progressively covering said rib in response to flattening said boot or shoe on said ski, wherein the groove further comprises:

an anterior metatarsus support zone; and a posterior heel support zone, wherein the height of said rib in said anterior metatarsus support zone is less than the depth of said groove in said anterior metatarsus support zone, wherein said upper surface of said ski comprises two zones positioned on either side of said rib, wherein said sole is supported on said two zones of said upper surface of said ski, wherein the height of said rib in said posterior heel zone is greater than the depth of said groove in said posterior heel zone, wherein said heel of said boot or shoe is supported only on said central zone of said upper surface of said rib.

16. The apparatus defined by claim 15 wherein said central zone is positioned in said posterior heel support zone of said rib, wherein said two zones of said ski extend laterally from either lateral side of said rib, wherein said upper portion of said ski comprises said upper surface of said ski.

17. An apparatus for laterally guiding and supporting a boot or shoe on a ski, wherein said apparatus comprises:

a longitudinally extending guidance element on the upper surface of said ski, wherein said element comprises a front portion and a rear portion; and a support element for supporting said boot, wherein said support element comprises a groove, wherein said support element and said groove comprise a front portion and a rear portion, wherein said groove has substantially the same cross-sectional configuration as said guidance element, wherein said front portion of said guidance element comprises means for engaging said front portion of said groove, wherein said rear portion of said guidance element comprises means for engaging said rear portion of said groove, wherein the height of said front portion of said guidance element is less than the depth of said front portion of said groove, wherein the height of said rear portion of said guidance element is greater than the depth of said rear portion of said groove.

18. The apparatus defined by claim 17 wherein said front portion of said support element comprises an anterior metatarsus support zone for supporting the metatarses of said foot, wherein said rear portion of said support element comprises a posterior heel support zone for supporting the heel of said foot.

19. The apparatus defined by claim 18 wherein said support element comprises a sole of said boot, wherein said boot comprises a cross-country ski boot attachable at its front end to a cross-country ski so as to permit the heel of said foot to be lifted at least vertically above said ski.

* * * * *

UNITED STATES PATENT AND TRADEMARK OFFICE

CERTIFICATE OF CORRECTION

PATENT NO. : 4,789,177

DATED : December 6, 1988

INVENTOR(S) : Gerard GRAILLAT

It is certified that error appears in the above-identified patent and that said Letters Patent is hereby corrected as shown below:

At column 1, line 66, change "and upper" to ---an upper---.

At column 3, line 28, change "bordring" to ---bordering---.

At column 5, line 14, change "an" to ---can---.

At column 5, line 31, change "preset" to ---present---.

At column 5, line 62, change "whichis" to ---which is---.

Signed and Sealed this

Sixteenth Day of March, 1993

*Attest:*

STEPHEN G. KUNIN

*Attesting Officer*

*Acting Commissioner of Patents and Trademarks*